US006309312B1

(12) United States Patent
Sullivan et al.

(10) Patent No.: US 6,309,312 B1
(45) Date of Patent: Oct. 30, 2001

(54) GOLF BALL COMPRISING A METAL MANTLE HAVING A HOLLOW INTERIOR

(75) Inventors: Michael J. Sullivan, Chicopee; R. Dennis Nesbitt, Westfield, both of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 08/966,446

(22) Filed: Nov. 7, 1997

Related U.S. Application Data

(63) Continuation-in-part of application No. 08/714,661, filed on Sep. 16, 1996.

(60) Provisional application No. 60/042,120, filed on Mar. 28, 1997, and provisional application No. 60/042,430, filed on Mar. 28, 1997.

(51) Int. Cl.[7] ..... A63B 37/04

(52) U.S. Cl. ..... 473/375; 473/372; 473/358

(58) Field of Search ..... 473/358, 360, 473/375, 372

(56) References Cited

U.S. PATENT DOCUMENTS

| | | | | |
|---|---|---|---|---|
| 696,887 | | 1/1902 | Kempshall . | |
| 696,890 | | 4/1902 | Kempshall . | |
| 696,891 | | 4/1902 | Kempshall . | |
| 696,895 | | 4/1902 | Kempshall . | |
| 697,816 | | 4/1902 | Davis . | |
| 697,925 | | 4/1902 | Kempshall . | |
| 699,089 | | 4/1902 | Kempshall . | |
| 700,656 | | 5/1902 | Kempshall . | |
| 700,658 | * | 5/1902 | Kempshall | 473/376 |
| 700,660 | | 5/1902 | Kempshall . | |
| 701,741 | | 6/1902 | Kempshall . | |
| 704,748 | | 7/1902 | Kempshall . | |
| 704,838 | | 7/1902 | Kempshall . | |
| 705,249 | | 7/1902 | Kempshall . | |
| 705,359 | | 7/1902 | Kempshall . | |
| 707,263 | | 8/1902 | Saunders . | |
| 711,177 | | 10/1902 | Richards . | |
| 711,227 | | 10/1902 | Richards . | |
| 711,474 | | 10/1902 | Chapman . | |
| 712,413 | | 10/1902 | Richards . | |
| 713,772 | * | 11/1902 | Kempshall | 473/376 |
| 719,499 | | 2/1903 | Painter . | |
| 720,852 | | 2/1903 | Smith, Jr. . | |
| 727,200 | | 5/1903 | Richards . | |
| 739,753 | | 9/1903 | Kempshall . | |
| 740,403 | | 10/1903 | Day . | |
| 906,644 | | 12/1908 | Meade . | |
| 985,741 | | 2/1911 | Harvey . | |
| 1,182,604 | | 5/1916 | Wadsworth . | |
| 1,182,605 | | 5/1916 | Wadsworth . | |
| 1,255,388 | | 2/1918 | Cobb . | |
| 1,270,008 | | 6/1918 | Cobb . | |
| 1,339,992 | | 5/1920 | Wais . | |
| 1,568,514 | * | 1/1926 | Lewis | 473/376 |
| 1,586,514 | | 6/1926 | Arnott . | |
| 1,591,117 | | 7/1926 | Floyd . | |
| 2,055,326 | | 9/1936 | Young . | |
| 2,258,331 | | 10/1941 | Miller . | |
| 2,258,332 | | 10/1941 | Miller . | |
| 2,258,333 | | 10/1941 | Miller . | |

(List continued on next page.)

*Primary Examiner*—Mark S. Graham
*Assistant Examiner*—Raeann Gorden

(57) ABSTRACT

A unique golf ball and related methods of manufacturing are disclosed in which the golf ball comprises one or more metal mantle layers that define a hollow interior within the ball. The golf ball may also comprise an optional polymeric hollow spherical substrate inwardly disposed relative to the one or more metal mantle layers. The golf balls according to the present invention exhibit improved spin, feel, and acoustic properties. Furthermore, the one or more interior metal layers prevent, or at least significantly minimize, coefficient of restitution loss from the golf ball.

32 Claims, 2 Drawing Sheets

U.S. PATENT DOCUMENTS

| | | | | |
|---|---|---|---|---|
| 2,364,955 | | 12/1944 | Diddel . | |
| 2,786,684 | | 3/1957 | Muccino . | |
| 2,882,058 | * | 4/1959 | Brandon | 473/358 |
| 3,031,194 | | 4/1962 | Strayer . | |
| 3,218,075 | | 11/1965 | Shakespeare . | |
| 3,534,965 | | 10/1970 | Harrison et al. . | |
| 3,572,721 | | 3/1971 | Harrison et al. . | |
| 3,572,722 | | 3/1971 | Harrison et al. . | |
| 3,671,477 | | 6/1972 | Nesbitt . | |
| 3,908,993 | | 9/1975 | Gentiluomo . | |
| 3,940,145 | | 2/1976 | Gentiluomo . | |
| 4,085,937 | | 4/1978 | Schenk . | |
| 4,123,061 | | 10/1978 | Dusbiber . | |
| 4,431,193 | | 2/1984 | Nesbitt . | |
| 4,483,537 | | 11/1984 | Hanada et al. . | |
| 4,653,758 | | 3/1987 | Solheim . | |
| 4,674,751 | | 6/1987 | Molitor et al. . | |
| 4,679,795 | | 7/1987 | Melvin et al. . | |
| 4,805,914 | | 2/1989 | Toland . | |
| 4,836,552 | | 6/1989 | Puckett et al. . | |
| 4,839,116 | | 6/1989 | Puckett et al. . | |
| 4,844,471 | | 7/1989 | Terence et al. . | |
| 4,863,167 | | 9/1989 | Matsuki et al. . | |
| 4,884,814 | | 12/1989 | Sullivan . | |
| 4,886,275 | | 12/1989 | Walker . | |
| 4,911,451 | | 3/1990 | Sullivan et al. . | |
| 4,919,434 | | 4/1990 | Saito . | |
| 4,943,055 | | 7/1990 | Corley . | |
| 4,986,545 | | 1/1991 | Sullivan . | |
| 4,995,613 | | 2/1991 | Walker . | |
| 5,002,281 | | 3/1991 | Nakahara et al. . | |
| 5,018,740 | | 5/1991 | Sullivan . | |
| 5,020,803 | | 6/1991 | Gendreau et al. . | |
| 5,037,104 | | 8/1991 | Watanabe et al. . | |
| 5,048,838 | | 9/1991 | Chikaraishi et al. . | |
| 5,068,151 | * | 11/1991 | Nakamura | 473/351 |
| 5,098,105 | | 3/1992 | Sullivan . | |
| 5,120,791 | | 6/1992 | Sullivan . | |
| 5,150,905 | | 9/1992 | Yuki et al. . | |
| 5,150,906 | | 9/1992 | Molitor et al. . | |
| 5,184,838 | | 2/1993 | Kim et al. . | |
| 5,187,013 | | 2/1993 | Sullivan . | |
| 5,194,191 | | 3/1993 | Nomura et al. . | |
| 5,253,871 | | 10/1993 | Viollaz . | |
| 5,273,286 | | 12/1993 | Sun . | |
| 5,314,187 | | 5/1994 | Proudfit . | |
| 5,421,580 | | 6/1995 | Sugimoto et al. . | |
| 5,439,227 | | 8/1995 | Egashira et al. . | |
| 5,452,898 | | 9/1995 | Yamagishi et al. . | |
| 5,480,155 | | 1/1996 | Molitor et al. . | |
| 5,511,791 | | 4/1996 | Ebisuno et al. . | |
| 5,586,950 | | 12/1996 | Endo . | |
| 5,645,497 | | 7/1997 | Sullivan et al. . | |
| 5,688,192 | | 11/1997 | Aoyama . | |
| 5,759,676 | | 6/1998 | Cavallaro et al. . | |
| 5,913,736 | * | 6/1999 | Maehara et al. | 473/373 |
| 6,004,225 | * | 12/1999 | Owens et al. | 473/372 |

* cited by examiner

GOLF BALL COMPRISING A METAL MANTLE HAVING A HOLLOW INTERIOR

CROSS REFERENCE TO RELATED APPLICATIONS

This application claims priority from U.S. Provisional Application Ser. No. 60/042,120, filed Mar. 28, 1997; Provisional Application Ser. No. 60/042,430, filed Mar. 28, 1997; and a continuation-in-part of U.S. Application Ser. No. 08/714,661, filed Sep. 16, 1996.

FIELD OF THE INVENTION

The present invention relates to golf balls and, more particularly, to golf balls comprising one or more metal mantle layers and which do not utilize a core or core component and so, are essentially hollow. The golf balls may comprise an optional polymeric outer cover and/or an inner polymeric hollow sphere substrate.

BACKGROUND OF THE INVENTION

Prior artisans have attempted to incorporate metal layers or metal filler particles in golf balls to alter the physical characteristics and performance of the balls. For example, U.S. Pat. No. 3,031,194 to Strayer is directed to the use of a spherical inner metal layer that is bonded or otherwise adhered to a resilient inner constituent within the ball. The ball utilizes a liquid filled core. U.S. Pat. No. 4,863,167 to Matsuki, et al. describes golf balls containing a gravity filler which may be formed from one or more metals disposed within a solid rubber-based core. U.S. Pat. Nos. 4,886,275 and 4,995,613, both to Walker, disclose golf balls having a dense metal-containing core. U.S. Pat. No. 4,943,055 to Corley is directed to a weighted warmup ball having a metal center.

Prior artisans have also described golf balls having one or more interior layers formed from a metal, and which feature a hollow center. Davis disclosed a golf ball comprising a spherical steel shell having a hollow air-filled center in U.S. Pat. No. 697,816. Kempshall received numerous patents directed to golf balls having metal inner layers and hollow interiors, such as U.S. Pat. No. 704,748; 704,838; 713,772; and 739,753. In U.S. Pat. Nos. 1,182,604 and 1,182,605, Wadsworth described golf balls utilizing concentric spherical shells formed from tempered steel. U.S. Pat. No. 1,568,514 to Lewis describes several embodiments for a golf ball, one of which utilizes multiple steel shells disposed within the ball, and which provide a hollow center for the ball.

Although satisfactory in at least some respects, all of the foregoing ball constructions are deficient, particularly when considered in view of the stringent demands of the current golf industry. As will be appreciated, the golf balls disclosed by Davis and Kempshall, all patented in 1902 or 1903, would be entirely unacceptable for the golf industry at present. Similarly, the ball configurations described by Wadsorth and Lewis in the above-noted patents, issued in 1916 and 1926 respectively, would not meet the demands of today's golf industry. Specifically, there is a need for a golf ball that exhibits a high initial velocity or coefficient of restitution (COR), may be driven relatively long distances in regulation play, and which may be readily and inexpensively manufactured.

These and other objects and features of the invention will be apparent from the following summary and description of the invention, the drawings, and from the claims.

SUMMARY OF THE INVENTION

The present invention achieves the foregoing objectives and provides a golf ball comprising one or more metal mantle layers that define a relatively large hollow interior within the ball. Specifically, the present invention provides, in a first aspect, a golf ball having a hollow spherical center, and comprising a spherical metal mantle and a polymeric outer cover disposed about and adjacent to the metal mantle. The metal mantle is preferably formed from steel, titanium, chromium, nickel, or alloys thereof. The metal mantle may comprise one or more layers, each formed from a different metal. The polymeric outer cover is preferably relatively soft and formed from a low acid ionomer, a non-ionomer, or a blend thereof.

In a second aspect, the present invention provides a golf ball having a hollow interior, and comprising an inner polymeric hollow spherical substrate, a spherical metal mantle, and a polymeric outer cover. The spherical metal mantle is disposed between the spherical substrate and the outer cover.

In yet another aspect, the present invention provides a golf ball having a hollow spherical metal mantle, the outer surface of which constitutes the outer surface of the golf ball. In an alternate variant, the essentially all metal hollow golf ball comprises a hollow polymeric spherical substrate disposed within the metal mantle.

The present invention also provides related methods of forming golf balls having metal mantles, with or without an inner polymeric hollow spherical substrate or an outer cover.

These and other objects and features of the invention will be apparent from the following detailed description.

DETAILED DESCRIPTION OF THE PREFERRED EMBODIMENTS

The present invention relates to golf balls comprising one or more metal mantle layers, and particularly, golf balls comprising such mantles and that do not utilize a core and so, feature a hollow interior. The present invention also relates to methods for making such golf balls.

Figure 1:
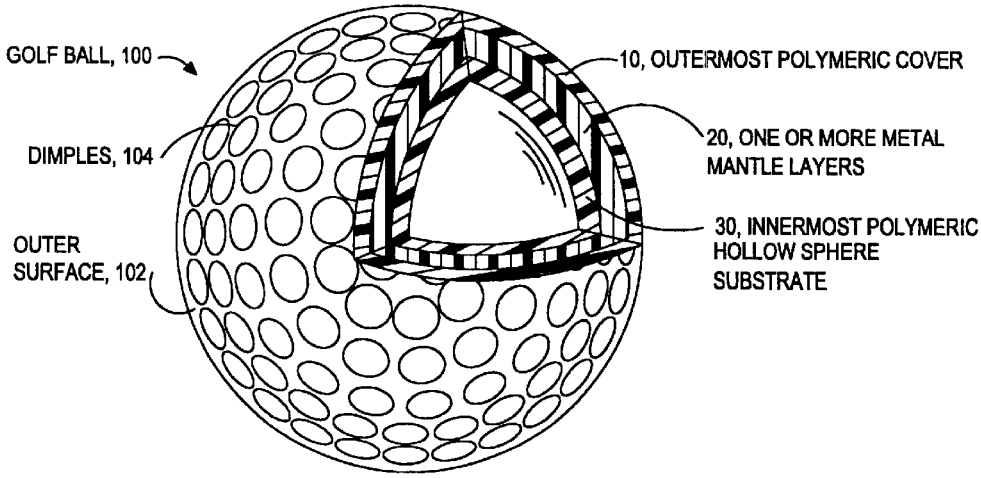
FIG. 1 is a partial cross-sectional view of a first preferred embodiment golf ball in accordance with the present invention, comprising a polymeric outer cover, one or more metal mantle layers, and an optional polymeric hollow sphere substrate.

FIG. 1 illustrates a first preferred embodiment golf ball 100 in accordance with the present invention. It will be understood that the referenced drawings are not necessarily to scale. The first preferred embodiment golf ball 100 comprises an outermost polymeric outer cover 10, one or more metal mantle layers 20, and an innermost polymeric hollow sphere substrate 30. The golf ball 100 provides a plurality of dimples 104 defined along an outer surface 102 of the golf ball 100.

Figure 2:
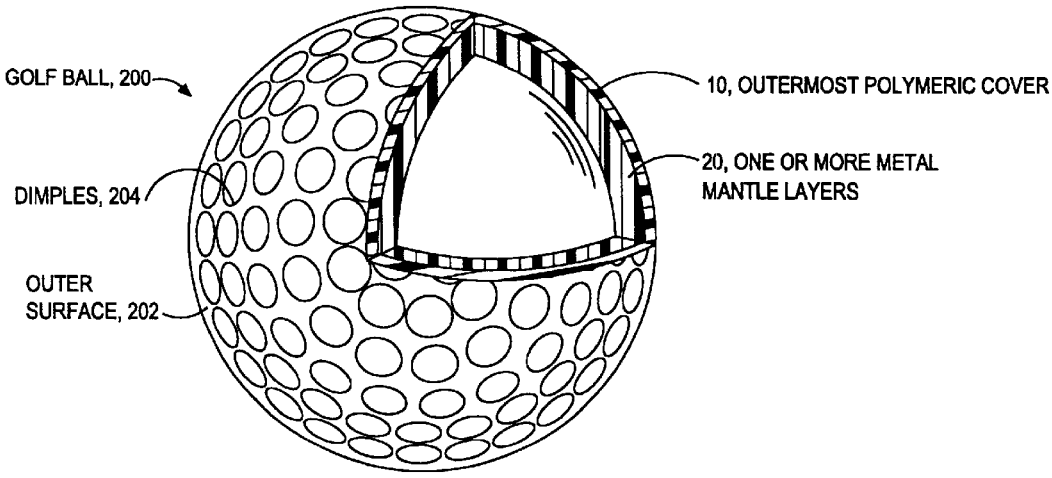
FIG. 2 is a partial cross-sectional view of a second preferred embodiment golf ball in accordance with the present invention, the golf ball comprising a polymeric outer cover and one or more metal mantle layers.

FIG. 2 illustrates a second preferred embodiment golf ball 200 in accordance with the present invention. The golf ball

200 comprises an outermost polymeric outer cover 10 and one or more metal mantle layers 20. The second preferred embodiment golf ball 200 provides a plurality of dimples 204 defined along the outer surface 202 of the ball.

Figure 3:
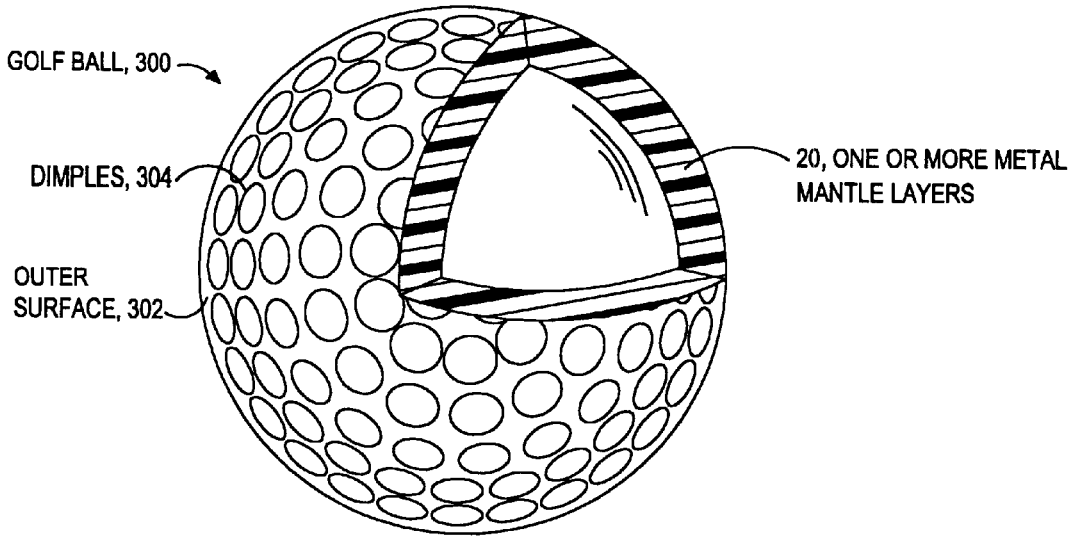
FIG. 3 is a partial cross-sectional view of a third preferred embodiment golf ball in accordance with the present invention, the golf ball comprising one or more metal mantle layers.

FIG. 3 illustrates a third preferred embodiment golf ball 300 in accordance with the present invention. The golf ball 300 comprises one or more metal mantle layers 20. The golf ball 300 provides a plurality of dimples 304 defined along the outer surface 302 of the golf ball 300.

Figure 4:
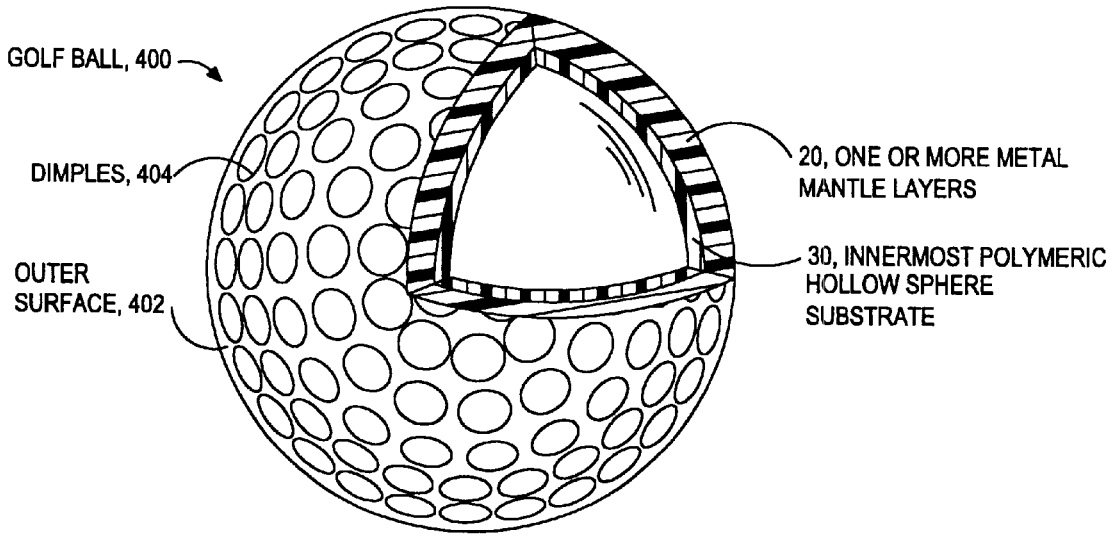
FIG. 4 is partial cross-sectional view of a fourth preferred embodiment golf ball in accordance with the present invention, the golf ball comprising one or more metal mantle layers and an optional polymeric hollow sphere substrate.

FIG. 4 illustrates a fourth preferred embodiment golf ball 400 in accordance with the present invention. The golf ball 400 comprises one or more metal mantle layers 20 and an optional polymeric hollow sphere substrate 30. The golf ball 400 provides a plurality of dimples 404 defined along the outer surface 402 of the golf ball 400.

In all the foregoing noted preferred embodiments, i.e. golf balls 100, 200, 300, and 400, the golf balls do not utilize a core or core component. Instead, all preferred embodiment golf balls feature a hollow interior or hollow core. As described in greater detail below, the interior of the present invention golf balls may include one or more gases, preferably at a pressure greater than 1 atmosphere. In addition, all preferred embodiment golf balls comprise one or more metal mantle layers. Details of the materials, configuration, and construction of each component in the preferred embodiment golf balls are set forth below.

Polymeric Outer Cover

The polymeric outer cover layer is comprised of a relatively soft, low modulus (about 1,000 psi to about 10,000 psi) and low acid (less than 16 weight percent acid) ionomer, ionomer blend or a non-ionomeric thermoplastic elastomer such as, but not limited to, a polyurethane, a polyester elastomer such as that marketed by DuPont under the trademark Hytrel®, or a polyester amide such as that marketed by Elf Atochem S.A. under the trademark Pebax®.

Preferably, the outer layer includes a blend of hard and soft (low acid) ionomer resins such as those described in U.S. Pat. Nos. 4,884,814 and 5,120,791, both incorporated herein by reference. Specifically, a desirable material for use in molding the outer layer comprises a blend of a high modulus (hard) ionomer with a low modulus (soft) ionomer to form a base ionomer mixture. A high modulus ionomer herein is one which measures from about 15,000 to about 70,000 psi as measured in accordance with ASTM method D-790. The hardness may be defined as at least 50 on the Shore D scale as measured in accordance with ASTM method D-2240. A low modulus ionomer suitable for use in the outer layer blend has a flexural modulus measuring from about 1,000 to about 10,000 psi, with a hardness of about 20 to about 40 on the Shore D scale.

The hard ionomer resins utilized to produce the outer cover layer composition hard/soft blends include ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

The hard ionomeric resins are likely copolymers of ethylene and either acrylic and/or methacrylic acid, with copolymers of ethylene and acrylic acid being the most preferred. Two or more types of hard ionomeric resins may be blended into the outer cover layer compositions in order to produce the desired properties of the resulting golf balls.

The hard ionomeric resins developed by Exxon Corporation and introduced under the designation Escor® and sold under the designation "Iotek" are somewhat similar to the hard ionomeric resins developed by E. I. DuPont de Nemours & Company and sold under the Surlyn® trademark. However, since the "Iotek" ionomeric resins are sodium or zinc salts of poly(ethylene-acrylic acid) and the Surlyn® resins are zinc or sodium salts of poly(ethylene-methacrylic acid) some distinct differences in properties exist. As more specifically indicated in the data set forth below, the hard "Iotek" resins (i.e., the acrylic acid based hard ionomer resins) are the more preferred hard resins for use in formulating the outer cover layer blends for use in the present invention. In addition, various blends of "Iotek" and Surlyn® hard ionomeric resins, as well as other available ionomeric resins, may be utilized in the present invention in a similar manner.

Examples of commercially available hard ionomeric resins which may be used in the present invention in formulating the outer cover blends include the hard sodium ionic copolymer sold under the trademark Surlyn® 8940 and the hard zinc ionic copolymer sold under the trademark Surlyn® 9910. Surlyn® 8940 is a copolymer of ethylene with methacrylic acid and about 15 weight percent acid which is about 29 percent neutralized with sodium ions. This resin has an average melt flow index of about 2.8. Surlyn® 9910 is a copolymer of ethylene and methacrylic acid with about 15 weight percent acid which is about 58 percent neutralized with zinc ions. The average melt flow index of Surlyn® 9910 is about 0.7. The typical properties of Surlyn® 9910 and 8940 are set forth below in Table 1:

TABLE 1

Typical Properties of Commercially Available Hard Surlyn ® Resins Suitable for Use in the Outer Layer Blends of the Preferred Embodiments

| | ASTM D | 8940 | 9910 | 8920 | 8528 | 9970 | 9730 |
|---|---|---|---|---|---|---|---|
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, | D-638 | (4.8) | (3.6) | (5.4) | (4.2) | (3.2) | (4.1) |
| (kpsi), MPa | | 33.1 | 24.8 | 37.2 | 29.0 | 22.0 | 28.0 |
| Elongation, % | D-638 | 470 | 290 | 350 | 450 | 460 | 460 |
| Flexural Modulus, | D-790 | (51) | (48) | (55) | (32) | (28) | (30) |

TABLE 1-continued

| Typical Properties of Commercially Available Hard Surlyn ® Resins Suitable for Use in the Outer Layer Blends of the Preferred Embodiments | | | | | | | |
|---|---|---|---|---|---|---|---|
| | ASTM D | 8940 | 9910 | 8920 | 8528 | 9970 | 9730 |
| (kpsi) MPa | | 350 | 330 | 380 | 220 | 190 | 210 |
| Tensile Impact (23° C.) | D-1822S | 1020 | 1020 | 865 | 1160 | 760 | 1240 |
| $KJ/m^2$ (ft.- lbs./$in^2$) | | (485) | (485) | (410) | (550) | (360) | (590) |
| Vicat Temperature, ° C. | D-1525 | 63 | 62 | 58 | 73 | 61 | 73 |

Examples of the more pertinent acrylic acid based hard ionomer resin suitable for use in the present outer cover composition sold under the "Iotek" tradename by the Exxon Corporation include Iotek 4000, Iotek 4010, Iotek 8000, Iotek 8020 and Iotek 8030. The typical properties of these and other Iotek hard ionomers suited for use in formulating the outer layer cover composition are set forth below in Table 2:

TABLE 2

| Typical Properties of Iotek Ionomers | | ASTM Method | Units | 4000 | 4010 | 8000 | 8020 | 8030 |
|---|---|---|---|---|---|---|---|---|
| Resin Properties | | | | | | | | |
| Cation type | | | | zinc | zinc | sodium | sodium | sodium |
| Melt index | | D-1238 | g/10 min. | 2.5 | 1.5 | 0.8 | 1.6 | 2.8 |
| Density | | D-1505 | $kg/m^3$ | 963 | 963 | 954 | 960 | 960 |
| Melting Point | | D-3417 | ° C. | 90 | 90 | 90 | 87.5 | 87.5 |
| Crystallization Point | | D-3417 | ° C. | 62 | 64 | 56 | 53 | 55 |
| Vicat Softening Point | | D-1525 | ° C. | 62 | 63 | 61 | 64 | 67 |
| % weight Acrylic Acid | | | | 16 | | 11 | | |
| % of Acid Groups cation neutralized | | | | 30 | | 40 | | |
| Plaque Properties (3 mm thick, compression molded) | | | | | | | | |
| Tensile at break | | D-638 | MPa | 24 | 26 | 36 | 31.5 | 28 |
| Yield point | | D-638 | MPa | none | none | 21 | 21 | 23 |
| Elongation at break | | D-638 | % | 395 | 420 | 350 | 410 | 395 |
| 1% Secant modulus | | D-638 | MPa | 160 | 160 | 3300 | 350 | 390 |
| Shore Hardness D | | D-2240 | — | 55 | 55 | 61 | 58 | 59 |
| Film Properties (50 micron film 2.2:1 Blow-up ratio) | | | | | | | | |
| Tensile at Break | MD | D-882 | MPa | 41 | 39 | 42 | 52 | 47.4 |
| | TD | D-882 | MPa | 37 | 38 | 38 | 38 | 40.5 |
| Yield point | MD | D-882 | MPa | 15 | 17 | 17 | 23 | 21.6 |
| | TD | D-882 | MPa | 14 | 15 | 15 | 21 | 20.7 |
| Elongation at Break | | | | | | | | |
| | MD | D-882 | % | 310 | 270 | 260 | 295 | 305 |
| | TD | D-882 | % | 360 | 340 | 280 | 340 | 345 |
| 1% Secant modulus | MD | D-882 | MPa | 210 | 215 | 390 | 380 | 380 |
| | TD | D-882 | MPa | 200 | 225 | 380 | 350 | 345 |
| Dart Drop Impact | D-1709 | g/micron | | 12.4 | 12.5 | 20.3 | | |

| | ASTM Method | Units | 7010 | 7020 | 7030 |
|---|---|---|---|---|---|
| Resin Properties | | | | | |
| Cation type | | | zinc | zinc | zinc |
| Melt Index | D-1238 | g/10 min. | 0.8 | 1.5 | 2.5 |
| Density | D-1505 | $kg/m^3$ | 960 | 960 | 960 |
| Melting Point | D-3417 | ° C. | 90 | 90 | 90 |
| Crystallization Point | D-3417 | ° C. | — | — | — |
| Vicat Softening Point | D-1525 | ° C. | 60 | 63 | 62.5 |

TABLE 2-continued

| Typical Properties of Iotek Ionomers | | | | | |
|---|---|---|---|---|---|
| % Weight Acrylic Acid | | | — | — | — |
| % of Acid Groups | | | — | — | — |
| Cation Neutralized | | | | | |
| Plaque Properties (3 mm thick, compression molded) | | | | | |
| Tensile at break | D-638 | MPa | 38 | 38 | 38 |
| Yield Point | D-638 | MPa | none | none | none |
| Elongation at break | D-638 | % | 500 | 420 | 395 |
| 1% Secant modulus | D-638 | MPa | — | — | — |
| Shore Hardness D | D-2240 | — | 57 | 55 | 55 |

Comparatively, soft ionomers are used in formulating the hard/soft blends of the outer cover composition. These ionomers include acrylic acid based soft ionomers. They are generally characterized as comprising sodium or zinc salts of a terpolymer of an olefin having from about 2 to 8 carbon atoms, acrylic acid, and an unsaturated monomer of the acrylate ester class having from 1 to 21 carbon atoms. The soft ionomer is preferably a zinc based ionomer made from an acrylic acid base polymer and an unsaturated monomer of the acrylate ester class. The soft (low modulus) ionomers have a hardness from about 20 to about 40 as measured on the Shore D scale and a flexural modulus from about 1,000 to about 10,000, as measured in accordance with ASTM method D-790.

Certain ethylene-acrylic acid based soft ionomer resins developed by the Exxon Corporation under the designation "Iotek 7520" (referred to experimentally by differences in neutralization and melt indexes as LDX 195, LDX 196, LDX 218 and LDX 219) may be combined with known hard ionomers such as those indicated above to produce the outer cover. The combination produces higher COR's (coefficient of restitution) at equal or softer hardness, higher melt flow (which corresponds to improved, more efficient molding, i.e., fewer rejects) as well as significant cost savings versus the outer layer of multi-layer balls produced by other known hard-soft ionomer blends as a result of the lower overall raw materials costs and improved yields.

While the exact chemical composition of the resins to be sold by Exxon under the designation Iotek 7520 is considered by Exxon to be confidential and proprietary information, Exxon's experimental product data sheet lists the following physical properties of the ethylene acrylic acid zinc ionomer developed by Exxon:

TABLE 3

| Physical Properties of Iotek 7520 | | | |
|---|---|---|---|
| Property | ASTM Method | Units | Typical Value |
| Melt Index | D-1238 | g/10 min. | 2 |
| Density | D-1505 | $kg/m^3$ | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | MPa | 10 |
| Yield Point | D-638 | MPa | None |
| Elongation at Break | D-638 | % | 760 |
| 1% Secant Modulus | D-638 | MPa | 22 |

TABLE 3-continued

| Physical Properties of Iotek 7520 | | | |
|---|---|---|---|
| Property | ASTM Method | Units | Typical Value |
| Shore D Hardness | D-2240 | 32 | |
| Flexural Modulus | D-790 | MPa | 26 |
| Zwick Rebond | ISO 4862 | % | 52 |
| De Mattia Flex Resistance | D-430 | Cycles | >5000 |

In addition, test data collected by the inventor indicates that Iotek 7520 resins have Shore D hardnesses of about 32 to 36 (per ASTM D-2240), melt flow indexes of 3±0.5 g/10 min (at 190° C. per ASTM D-1288), and a flexural modulus of about 2500–3500 psi (per ASTM D-790). Furthermore, testing by an independent testing laboratory by pyrolysis mass spectrometry indicates that Iotek 7520 resins are generally zinc salts of a terpolymer of ethylene, acrylic acid, and methyl acrylate.

Furthermore, the inventor has found that a newly developed grade of an acrylic acid based soft ionomer available from the Exxon Corporation under the designation Iotek 7510, is also effective, when combined with the hard ionomers indicated above in producing golf ball covers exhibiting higher COR values at equal or softer hardness than those produced by known hard-soft ionomer blends. In this regard, Iotek 7510 has the advantages (i.e. improved flow, higher COR values at equal hardness, increased clarity, etc.) produced by the Iotek 7520 resin when compared to the methacrylic acid base soft ionomers known in the art (such as the Surlyn 8625 and the Surlyn 8629 combinations disclosed in U.S. Pat. No. 4,884,814).

In addition, Iotek 7510, when compared to Iotek 7520, produces slightly higher COR values at equal softness/hardness due to the Iotek 7510's higher hardness and neutralization. Similarly, Iotek 7510 produces better release properties (from the mold cavities) due to its slightly higher stiffness and lower flow rate than Iotek 7520. This is important in production where the soft covered balls tend to have lower yields caused by sticking in the molds and subsequent punched pin marks from the knockouts.

According to Exxon, Iotek 7510 is of similar chemical composition as Iotek 7520 (i.e. a zinc salt of a terpolymer of ethylene, acrylic acid, and methyl acrylate) but is more highly neutralized. Based upon FTIR analysis, Iotek 7520 is estimated to be about 30–40 weight percent neutralized and Iotek 7510 is estimated to be about 40–60 weight percent neutralized. The typical properties of Iotek 7510 in comparison with those of Iotek 7520 are set forth below:

TABLE 4

| Physical Properties of Iotek 7510 in Comparison to Iotek 7520 | IOTEK 7520 | IOTEK 7510 |
|---|---|---|
| MI, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, Psi | 1450 | 1750 |
| Elongation, % | 760 | 690 |
| Hardness, Shore D | 32 | 35 |

It has been determined that when hard/soft ionomer blends are used for the outer cover layer, good results are achieved when the relative combination is in a range of about 90 to about 10 percent hard ionomer and about 10 to about 90 percent soft ionomer. The results are improved by adjusting the range to about 75 to 25 percent hard ionomer and 25 to 75 percent soft ionomer. Even better results are noted at relative ranges of about 60 to 90 percent hard ionomer resin and about 40 to 60 percent soft ionomer resin.

Specific formulations which may be used in the cover composition are included in the examples set forth in U.S. Pat. Nos. 5,120,791 and 4,884,814. The present invention is in no way limited to those examples.

Moreover, in alternative embodiments, the outer cover layer formulation may also comprise a soft, low modulus non-ionomeric thermoplastic elastomer including a polyester polyurethane such as B. F. Goodrich Company's Estane® polyester polyurethane X-4517. According to B. F. Goodrich, Estane® X-4517 has the following properties:

TABLE 5

| Properties of Estane ® X-4517 | |
|---|---|
| Tensile | 1430 |
| 100% | 815 |
| 200% | 1024 |
| 300% | 1193 |
| Elongation | 641 |

TABLE 5-continued

| Properties of Estane ® X-4517 | |
|---|---|
| Youngs Modulus | 1826 |
| Hardness A/D | 88/39 |
| Dayshore Rebound | 59 |
| Solubility in Water | Insoluble |
| Melt processing temperature | >350° F. (>177° C.) |
| Specific Gravity ($H_2O$ = 1) | 1.1–1.3 |

Other soft, relatively low modulus non-ionomeric thermoplastic elastomers may also be utilized to produce the outer cover layer as long as the non-ionomeric thermoplastic elastomers produce the playability and durability characteristics desired without adversely effecting the enhanced travel distance characteristic produced by the high acid ionomer resin composition. These include, but are not limited to thermoplastic polyurethanes such as: Texin thermoplastic polyurethanes from Mobay Chemical Co. and the Pellethane thermoplastic polyurethanes from Dow Chemical Co.; Ionomer/rubber blends such as those in Spalding U.S. Pat. Nos. 4,986,545; 5,098,105 and 5,187,013; and, Hytrel polyester elastomers from DuPont and Pebax polyester amides from Elf Atochem S.A.

The polymeric outer cover layer is about 0.020 inches to about 0.120 inches in thickness. The outer cover layer is preferably about 0.050 inches to about 0.075 inches in thickness. Together, the mantle and the outer cover layer combine to form a ball having a diameter of 1.680 inches or more, the minimum diameter permitted by the rules of the United States Golf Association and weighing about 1.620 ounces.

Multilayer Metal Mantle

The preferred embodiment golf balls of the present invention comprise one or more metal mantle layers disposed inwardly and proximate to, and preferably adjacent to, the outer cover layer. A wide array of metals can be used in the mantle layers or shells as described herein. Table 6, set forth below, lists suitable metals for use in the preferred embodiment golf balls.

TABLE 6

| Metals for Use in Mantle Layer(s) | | | | |
|---|---|---|---|---|
| Metal | Young's modulus, E, $10^6$ psi | Bulk modulus, K, $10^6$ psi | Shear modulus, G, $10^6$ psi | Poisson's ratio, v |
| Aluminum | 10.2 | 10.9 | 3.80 | 0.345 |
| Brass, 30 Zn | 14.6 | 16.2 | 5.41 | 0.350 |
| Chromium | 40.5 | 23.2 | 16.7 | 0.210 |
| Copper | 18.8 | 20.0 | 7.01 | 0.343 |
| Iron (soft) | 30.7 | 24.6 | 11.8 | 0.293 |
| (cast) | 22.1 | 15.9 | 8.7 | 0.27 |
| Lead | 2.34 | 6.64 | 0.811 | 0.44 |
| Magnesium | 6.48 | 5.16 | 2.51 | 0.291 |
| Molybdenum | 47.1 | 37.9 | 18.2 | 0.293 |
| Nickel (soft) | 28.9 | 25.7 | 11.0 | 0.312 |
| (hard) | 31.8 | 27.2 | 12.2 | 0.306 |
| Nickel-silver, 55Cu-18Ni-27Zn | 19.2 | 19.1 | 4.97 | 0.333 |
| Niobium | 15.2 | 24.7 | 5.44 | 0.397 |
| Silver | 12.0 | 15.0 | 4.39 | 0.367 |
| Steel, mild | 30.7 | 24.5 | 11.9 | 0.291 |
| Steel, 0.75 C | 30.5 | 24.5 | 11.8 | 0.293 |
| Steel, 0.75 C, hardened | 29.2 | 23.9 | 11.3 | 0.296 |

TABLE 6-continued

Metals for Use in Mantle Layer(s)

| Metal | Young's modulus, E, $10^6$ psi | Bulk modulus, K, $10^6$ psi | Shear modulus, G, $10^6$ psi | Poisson's ratio, v |
|---|---|---|---|---|
| Steel, tool | 30.7 | 24.0 | 11.9 | 0.287 |
| Steel, tool, hardened | 29.5 | 24.0 | 11.4 | 0.295 |
| Steel, stainless, 2Ni-18Cr | 31.2 | 24.1 | 12.2 | 0.283 |
| Tantalum | 26.9 | 28.5 | 10.0 | 0.342 |
| Tin | 7.24 | 8.44 | 2.67 | 0.357 |
| Titanium | 17.4 | 15.7 | 6.61 | 0.361 |
| Titanium/Nickel alloy | | | | |
| Tungsten | 59.6 | 45.1 | 23.3 | 0.280 |
| Vanadium | 18.5 | 22.9 | 6.77 | 0.365 |
| Zinc | 15.2 | 10.1 | 6.08 | 0.249 |

Preferably, the metals used in the one or more mantle layers are steel, titanium, chromium, nickel, or alloys thereof. Generally, it is preferred that the metal selected for use in the mantle be relatively stiff, hard, dense, and have a relatively high modulus of elasticity.

The thickness of the metal mantle layer depends upon the density of the metals used in that layer, or if a plurality of metal mantle layers are used, the densities of those metals in other layers within the mantle. Typically, the thickness of the mantle ranges from about 0.001 inches to about 0.050 inches. The preferred thickness for the mantle is from about 0.005 inches to about 0.050 inches. The most preferred range is from about 0.005 inches to about 0.010 inches. It is preferred that the thickness of the mantle be uniform and constant at all points across the mantle.

As noted, the thickness of the metal mantle depends upon the density of the metal(s) utilized in the one or more mantle layers. Table 7, set forth below, lists typical densities for the preferred metals for use in the mantle.

TABLE 7

| Metal | Density (grams per cubic centimeter) |
|---|---|
| Chromium | 6.46 |
| Nickel | 7.90 |
| Steel (approximate) | 7.70 |
| Titanium | 4.13 |

There are at least two approaches in forming a metal mantle utilized in the preferred embodiment golf balls. In a first embodiment, two metal half shells are stamped from metal sheet stock. The two half shells are then arc welded together and heat treated to stress relieve. It is preferred to heat treat the resulting assembly since welding will typically anneal and soften the resulting hollow sphere resulting in "oil canning," i.e. deformation of the metal sphere after impact, such as may occur during play. Optionally, a high temperature blowing agent may be added to the inside or interior of the halt shells prior to welding. Subsequent heat treatment will decompose the blowing agent and pressurize the hollow metal sphere with the gases produced from decomposition. A pressurized metal sphere will assist in preventing "oil canning" similar to a pressurized tennis ball or basketball. Moreover, the interior pressure will also increase the COR of the golf ball.

In a second embodiment, a metal mantle is formed via electroplating over a thin hollow polymeric sphere, described in greater detail below. This polymeric sphere may correspond to the previously described optional polymeric hollow sphere substrate 30. There are several preferred techniques by which a metallic mantle layer may be deposited upon a non-metallic substrate. In a first category of techniques, an electrically conductive layer is formed or deposited upon the polymeric or non-metallic sphere. Electroplating may be used to fully deposit a metal layer after a conductive salt solution is applied onto the surface of the non-metallic substrate. Alternatively, or in addition, a thin electrically conducting metallic surface can be formed by flash vacuum metallization of a metal agent, such as aluminum, onto the substrate of interest. Such surfaces are typically about $3\times10^{-6}$ of an inch thick. Once deposited, electroplating can be utilized to form the metal layer(s) of interest. It is contemplated that vacuum metallization could be employed to fully deposit the desired metal layer(s). Yet another technique for forming an electrically conductive metal base layer is chemical deposition. Copper, nickel, or silver, for example, may be readily deposited upon a non-metallic surface. Yet another technique for imparting electrical conductivity to the surface of a non-metallic substrate is to incorporate an effective amount of electrically conductive particles in the substrate, such as carbon black, prior to molding. Once having formed an electrically conductive surface, electroplating processes can be used to form the desired metal mantle layers.

Alternatively, or in addition, various thermal spray coating techniques can be utilized to form one or more metal mantle layers onto a spherical substrate. Thermal spray is a generic term generally used to refer to processes for depositing metallic and non-metallic coatings, sometimes known as metallizing, that comprise the plasma arc spray, electric arc spray, and flame spray processes. Coatings can be sprayed from rod or wire stock, or from powdered material.

A typical plasma arc spray system utilizes a plasma arc spray gun at which one or more gasses are energized to a highly energized state, i.e. a plasma, and are then discharged typically under high pressures toward the substrate of interest. The power level, pressure, and flow of the arc gasses, and the rate of flow of powder and carrier gas are typically control variables.

The electric arc spray process preferably utilizes metal in wire form. This process differs from the other thermal spray processes in that there is no external heat source, such as from a gas flame or electrically induced plasma. Heating and melting occur when two electrically opposed charged wires, comprising the spray material, are fed together in such a manner that a controlled arc occurs at the intersection. The molten metal is atomized and propelled onto a prepared substrate by a stream of compressed air or gas.

The flame spray process utilizes combustible gas as a heat source to melt the coating material. Flame spray guns are available to spray materials in rod, wire, or powder form. Most flame spray guns can be adapted for use with several combinations of gases. Acetylene, propane, mapp gas, and oxygen-hydrogen are commonly used flame spray gases.

Another process or technique for depositing a metal mantle layer onto a spherical substrate in the preferred embodiment golf balls is chemical vapor deposition (CVD). In the CVD process, a reactant atmosphere is fed into a processing chamber where it decomposes at the surface of the substrate of interest, liberating one material for either absorption by or accumulation on the work piece or substrate. A second material is liberated in gas form and is removed from the processing chamber, along with excess atmosphere gas, as a mixture referred to as off-gas.

The reactant atmosphere that is typically used in CVD includes chlorides, fluorides, bromides and iodides, as well as carbonyls, organometallics, hydrides and hydrocarbons. Hydrogen is often included as a reducing agent. The reactant atmosphere must be reasonably stable until it reaches the substrate, where reaction occurs with reasonably efficient conversion of the reactant. Sometimes it is necessary to heat the reactant to produce the gaseous atmosphere. A few reactions for deposition occur at substrate temperatures below 200 degrees C. Some organometallic compounds deposit at temperatures of 600 degrees C. Most reactions and reaction products require temperatures above 800 degrees C.

Common CVD coatings include nickel, tungsten, chromium, and titanium carbide. CVD nickel is generally separated from a nickel carbonyl, $Ni(CO)_4$, atmosphere. The properties of the deposited nickel are equivalent to those of sulfonate nickel deposited electrolytically. Tungsten is deposited by thermal decomposition of tungsten carbonyl at 300 to 600 degrees C., or may be deposited by hydrogen reduction of tungsten hexachloride at 700 to 900 degrees C. The most convenient and most widely used reaction is the hydrogen reduction of tungsten hexafluoride. If depositing chromium upon an existing metal layer, this may be done by pack cementation, a process similar to pack carbonizing, or by a dynamic, flow-through CVD process. Titanium carbide coatings may be formed by the hydrogen reduction of titanium tetrafluoride in the presence of methane or some other hydrocarbon. The substrate temperatures typically range from 900 to 1010 degrees C., depending on the substrate.

Surface preparation for CVD coatings generally involve de-greasing or grit blasting. In addition, a CVD pre-coating treatment may be given. The rate of deposition from CVD reactions generally increases with temperature in a manner specific to each reaction. Deposition at the highest possible rate is preferable, however, there are limitations which require a processing compromise.

Vacuum coating is another category of processes for depositing metals and metal compounds from a source in a high vacuum environment onto a substrate, such as the spherical substrate used in several of the preferred embodiment golf balls. Three principal techniques are used to accomplish such deposition: evaporation, ion plating, and sputtering. In each technique, the transport of vapor is carried out in an evacuated, controlled environment chamber and, typically, at a residual air pressure of 1 to $10^{-5}$ Pascals.

In the evaporation process, vapor is generated by heating a source material to a temperature such that the vapor pressure significantly exceeds the ambient chamber pressure and produces sufficient vapor for practical deposition. To coat the entire surface of a substrate, such as the inner spherical substrate utilized in the preferred embodiment golf balls, it must be rotated and translated over the vapor source. Deposits made on substrates positioned at low angles to the vapor source generally result in fibrous, poorly bonded structures. Deposits resulting from excessive gas scattering are poorly adherent, amorphous, and generally dark in color. The highest quality deposits are made on surfaces nearly normal or perpendicular to the vapor flux. Such deposits faithfully reproduce the substrate surface texture. Highly polished substrates produce lustrous deposits, and the bulk properties of the deposits are maximized for the given deposition conditions.

For most deposition rates, source material should be heated to a temperature so that its vapor pressure is at least 1 Pascal or higher. Deposition rates for evaporating bulk vacuum coatings can be very high. Commercial coating equipment can deposit up to 500,000 angstroms of material thickness per minute using large ingot material sources and high powered electron beam heating techniques.

As indicated, the directionality of evaporating atoms from a vapor source generally requires the substrate to be articulated within the vapor cloud. To obtain a specific film distribution on a substrate, the shape of the object, the arrangement of the vapor source relative to the component surfaces, and the nature of the evaporation source may be controlled.

Concerning evaporation sources, most elemental metals, semi-conductors, compounds, and many alloys can be directly evaporated in vacuum. The simplest sources are resistance wires and metal foils. They are generally constructed of refractory metals, such as tungsten, molybdenum, and tantalum. The filaments serve the dual function of heating and holding the material for evaporation. Some elements serve as sublimation sources such as chromium, palladium, molybdenum, vanadium, iron, and silicon, since they can be evaporated directly from the solid phase. Crucible sources comprise the greatest applications in high volume production for evaporating refractory metals and compounds. The crucible materials are usually refractory metals, oxides, and nitrides, and carbon. Heating can be accomplished by radiation from a second refractory heating element, by a combination of radiation and conduction, and by radial frequency induction heating.

Several techniques are known for achieving evaporation of the evaporation source. Electron beam heating provides a flexible heating method that can concentrate heat on the evaporant. Portions of the evaporant next to the container can be kept at low temperatures, thus minimizing interaction. Two principal electron guns in use are the linear focusing gun, which uses magnetic and electrostatic focusing methods, and the bent-beam magnetically focused gun. Another technique for achieving evaporation is continuous feed high rate evaporation methods. High rate evaporation of alloys to form film thicknesses of 100 to 150 micrometers requires electron beam heating sources in large quantities of evaporant. Electron beams of 45 kilowatts or higher are used to melt evaporants in water cooled copper hearths up to 150 by 400 millimeters in cross section.

Concerning the substrate material of the spherical shell upon which one or more metal layers are formed in the preferred embodiment golf balls, the primary requirement of the material to be coated is that it be stable in vacuum. It must not evolve gas or vapor when exposed to the metal vapor. Gas evolution may result from release of gas absorbed on the surface, release of gas trapped in the pores of a porous substrate, evolution of a material such as plasticizers used in plastics, or actual vaporization of an ingredient in the substrate material.

In addition to the foregoing methods, sputtering may be used to deposit one or more metal layers onto, for instance, an inner hollow sphere substrate such as substrate 30 utilized in the preferred embodiment golf balls. Sputtering is a process wherein material is ejected from the surface of a solid or liquid because of a momentum exchange associated with bombardment by energetic particles. The bombarding species are generally ions of a heavy inert gas. Argon is most commonly used. The source of ions may be an ion beam or a plasma discharge into which the material can be bombarded is immersed.

In the plasma-discharge sputter coating process, a source of coating material called a target is placed in a vacuum chamber which is evacuated and then back filled with a working gas, such as Argon, to a pressure adequate to sustain the plasma discharge. A negative bias is then applied to the target so that it is bombarded by positive ions from the plasma.

Sputter coating chambers are typically evacuated to pressures ranging from 0.001 to 0.00001 Pascals before back filling with Argon to pressures of 0.1 to 10 Pascals. The intensity of the plasma discharge, and thus the ion flux and sputtering rate that can be achieved, depends on the shape of the cathode electrode, and on the effective use of a magnetic field to confine the plasma electrons. The deposition rate in sputtering depends on the target sputtering rate and the apparatus geometry. It also depends on the working gas pressure, since high pressures limit the passage of sputtered flux to the substrates.

Ion plating may also be used to form one or more metal mantle layers in the golf balls of the present invention. Ion plating is a generic term applied to atomistic film deposition processes in which the substrate surface and/or the depositing film is subjected to a flux of high energy particles (usually gas ions) sufficient to cause changes in the interfacial region or film properties. Such changes may be in the film adhesion to the substrate, film morphology, film density, film stress, or surface coverage by the depositing film material.

Ion plating is typically done in an inert gas discharge system similar to that used in sputtering deposition except that the substrate is the sputtering cathode and the bombarded surface often has a complex geometry. Basically, the ion plating apparatus is comprised of a vacuum chamber and a pumping system, which is typical of any conventional vacuum deposition unit. There is also a film atom vapor source and an inert gas inlet. For a conductive sample, the work piece is the high voltage electrode, which is insulated from the surrounding system. In the more generalized situation, a work piece holder is the high voltage electrode and either conductive or non-conductive materials for plating are attached to it. Once the specimen to be plated is attached to the high voltage electrode or holder and the filament vaporization source is loaded with the coating material, the system is closed and the chamber is pumped down to a pressure in the range of 0.001 to 0.0001 Pascals. When a desirable vacuum has been achieved, the chamber is back filled with Argon to a pressure of approximately 1 to 0.1 Pascals. An electrical potential of −3 to −5 kilovolts is then introduced across the high voltage electrode, that is the specimen or specimen holder, and the ground for the system. Glow discharge occurs between the electrodes which results in the specimen being bombarded by the high energy Argon ions produced in the discharge, which is equivalent to direct current sputtering. The coating source is then energized and the coating material is vaporized into the glow discharge.

Another class of materials, contemplated for use in forming the one or more metal mantle layers is nickel titanium alloys. These alloys are known to have super elastic properties and are approximately 50 percent (atomic) nickel and 50 percent titanium. When stressed, a super elastic nickel titanium alloy can accommodate strain deformations of up to 8 percent. When the stress is later released, the super elastic component returns to its original shape. Other shape memory alloys can also be utilized including alloys of copper zinc aluminum, and copper aluminum nickel. Table 8 set forth below presents various physical, mechanical, and transformation properties of these three preferred shape memory alloys.

TABLE 8

Properties of Shape Memory Alloys

| | Cu—Zn—Al | Cu—Al—Ni | Ni—Ti |
|---|---|---|---|
| PHYSICAL PROPERTIES | | | |
| Density (g/cm$^3$) | 7.64 | 7.12 | 6.5 |
| Resistivity ($\mu\Omega$-cm) | 8.5–9.7 | 11–13 | 80–100 |
| Thermal Conductivity (J/m-s-K) | 120 | 30–43 | 10 |
| Heat Capacity (J/Kg-K) | 400 | 373–574 | 390 |
| MECHANICAL PROPERTIES | | | |
| Young's Modulus (GPa) | | | |
| β-Phase | 72 | 85 | 83 |
| Martensite | 70 | 80 | 34 |
| Yield strength (MPa) | | | |
| β-Phase | 350 | 400 | 690 |
| Martensite | 80 | 130 | 70–150 |
| Ultimate Tensile Strength (Mpa) | 600 | 500–800 | 900 |
| TRANSFORMATION PROPERTIES | | | |
| Heat of Transformation (J/mole) | | | |
| Martensite | 160–440 | 310–470 | |
| R-Phase | | | 55 |
| Hysteresis (K) | | | |
| Martensite | 10–25 | 15–20 | 30–40 |
| R-Phase | | | 2–5 |
| Recoverable Strain (%) | | | |
| One-Way (Martensite) | 4 | 4 | 8 |
| One-Way (R-Phase | | | 0.5–1 |
| Two-Way (Martensite) | 2 | 2 | 3 |

In preparing the preferred embodiment golf balls, the polymeric outer cover layer, if utilized, is molded (for instance, by injection molding or by compression molding) about the metal mantle.

Polymeric Hollow Sphere

As shown in the accompanying Figures, namely FIGS. 1 and 4, the first preferred embodiment golf ball 100 and the fourth preferred embodiment golf ball 400 comprise a polymeric hollow sphere 30 immediately adjacent and inwardly disposed relative to the metal mantle 20. The polymeric hollow sphere can be formed from nearly any relatively strong plastic material. The thickness of the hollow sphere ranges from about 0.005 inches to about 0.010 inches. The hollow inner sphere can be formed using two half shells joined together via spin bonding, solvent welding, or other techniques known to those in the plastics processing arts. Alternatively, the hollow polymeric sphere may be formed via blow molding.

A wide array of polymeric materials can be utilized to form the polymeric hollow sphere. Thermoplastic materials are generally preferred for use as materials for the shell. Typically, such materials should exhibit good flowability, moderate stiffness, high abrasion resistance, high tear strength, high resilience, and good mold release, among others.

Synthetic polymeric materials which may be used in accordance with the present invention include homopolymeric and copolymer materials which may include: (1) vinyl resins formed by the polymerization of vinyl chloride, or by the copolymerization of vinyl chloride with vinyl acetate, acrylic esters or vinylidene chloride; (2) Polyolefins such as polyethylene, polypropylene, polybutylene, and copolymers such as polyethylene methylacrylate, polyethylene ethylacrylate, polyethylene vinyl acetate, polyethylene methacrylic or polyethylene acrylic acid or polypropylene acrylic acid or terpolymers made from these and acrylate esters and their metal ionomers, polypropylene/EPDM grafted with acrylic acid or anhydride modified polyolefins; (3) Polyurethanes, such as are prepared from polyols and diisocyanates or polyisocyanates; (4) Polyamides such as poly(hexamethylene adipamide) and others prepared from diamines and dibasic acids, as well as those from amino acid such as poly(caprolactam), and blends of polyamides with SURLYN, polyethylene, ethylene copolymers, EDPA, etc; (5) Acrylic resins and blends of these resins with polyvinyl chloride, elastomers, etc.; (6) Thermoplastic rubbers such as the urethanes, olefinic thermoplastic rubbers such as blends of polyolefins with EPDM, block copolymers of styrene and butadiene, or isoprene or ethylene-butylene rubber, polyether block amides; (7) Polyphenylene oxide resins, or blends of polyphenylene oxide with high impact polystyrene; (8) Thermoplastic polyesters, such as PET, PBT, PETG, and elastomers sold under the trademark HYTREL by E. I. DuPont De Nemours & Company of Wilmington, Del.; (9) Blends and alloys including polycarbonate with ABS, PBT, PET, SMA, PE elastomers, etc. and PVC with ABS or EVA or other elastomers; and (10) Blends of thermoplastic rubbers with polyethylene, polypropylene, polyacetal, nylon, polyesters, cellulose esters, etc.

It is also within the purview of this invention to add to the polymeric spherical substrate compositions of this invention materials which do not affect the basic novel characteristics of the composition. Among such materials are antioxidants, antistatic agents, and stabilizers.

Other Aspects of Preferred Embodiment Ball Construction

Additional materials may be added to the outer cover 10 including dyes (for example, Ultramarine Blue sold by Whitaker, Clark and Daniels of South Plainsfield, N.J.) (see U.S. Pat. No. 4,679,795 herein incorporated by reference); pigments such as titanium dioxide, zinc oxide, barium sulfate and zinc sulfate; UV absorbers; antioxidants; antistatic agents; and stabilizers. Further, the cover compositions may also contain softening agents, such as plasticizers, processing aids, etc. and reinforcing material such as glass fibers and inorganic fillers, as long as the desired properties produced by the golf ball covers are not impaired.

The outer cover layer may be produced according to conventional melt blending procedures. In the case of the outer cover layer, when a blend of hard and soft, low acid ionomer resins are utilized, the hard ionomer resins are blended with the soft ionomeric resins and with a masterbatch containing the desired additives in a Banbury mixer, two-roll mill, or extruder prior to molding. The blended composition is then formed into slabs and maintained in such a state until molding is desired. Alternatively, a simple dry blend of the pelletized or granulated resins and color masterbatch may be prepared and fed directly into an injection molding machine where homogenization occurs in the mixing section of the barrel prior to injection into the mold. If necessary, further additives such as an inorganic filler, etc., may be added and uniformly mixed before initiation of the molding process. A similar process is utilized to formulate the high acid ionomer resin compositions.

In place of utilizing a single outer cover, a plurality of cover layers may be employed. For example, an inner cover can be formed about the metal mantle, and an outer cover then formed about the inner cover. The thickness of the inner and outer cover layers are governed by the thickness parameters for the overall cover layer. The inner cover layer is preferably formed from a relatively hard material, such as, for example, the previously described high acid ionomer resin. The outer cover layer is preferably formed from a relatively soft material having a low flexural modulus.

In the event that an inner cover layer and an outer cover layer are utilized, these layers can be formed as follows. An inner cover layer may be formed by injection molding or compression molding an inner cover composition about a metal mantle to produce an intermediate golf ball having a diameter of about 1.50 to 1.67 inches, preferably about 1.620 inches. The outer layer is subsequently molded over the inner layer to produce a golf ball having a diameter of 1.680 inches or more.

In compression molding, the inner cover composition is formed via injection at about 380° F. to about 450° F. into smooth surfaced hemispherical shells which are then positioned around the mantle in a mold having the desired inner cover thickness and subjected to compression molding at 200° to 300° F. for about 2 to 10 minutes, followed by cooling at 50° to 70° F. for about 2 to 7 minutes to fuse the shells together to form a unitary intermediate ball. In addition, the intermediate balls may be produced by injection molding wherein the inner cover layer is injected directly around the mantle placed at the center of an intermediate ball mold for a period of time in a mold temperature of from 50° F. to about 100° F. Subsequently, the outer cover layer is molded about the core and the inner layer by similar compression or injection molding techniques to form a dimpled golf ball of a diameter of 1.680 inches or more.

After molding, the golf balls produced may undergo various further processing steps such as buffing, painting and marking as disclosed in U.S. Pat. No. 4,911,451 herein incorporated by reference.

The resulting golf ball produced from the high acid ionomer resin inner layer and the relatively softer, low flexural modulus outer layer exhibits a desirable coefficient of restitution and durability properties while at the same time offering the feel and spin characteristics associated with soft balata and balata-like covers of the prior art.

The present invention golf balls, in addition to comprising one or more metallic mantle layers, do not utilize a core or core component. The present invention golf balls feature a hollow interior. The hollow interior may, typically, include air or other gas or gas mixture. Moreover, the air or gas filled interior may be at an elevated pressure, ambient pressure, or a subatmospheric pressure. This hollow configuration eliminates the requirement of a core material and the attendant problems associated therewith such as the cost of the core material(s), manufacturing costs and difficulties in forming a core, and costs associated with selecting, and storing the core or core materials.

It is also contemplated to utilize a golf ball construction such as that depicted in either FIG. 2 or FIG. 3, in which the interior hollow region of the one or more metal layers 20 contains pressurized gas. It is preferred that the gas be at a pressure of at least about 1 atmosphere at typical playing conditions such as 70° F. It is preferred that the pressure be greater than 1 atmosphere. The gas may comprise air or any gases or gas mixture typically used for pressurizing recreational or sports balls and accessories. As will be appreciated, the interior region of a metal mantle or shell can be pressurized by introducing one or more gases through a fill hole which is subsequently closed or plugged. Alternatively, a gas-producing agent can be disposed within the interior of the mantle and shell and subsequently caused to release or generate gas.

In yet another embodiment, a metal shell is disposed along the outermost periphery of the golf ball and hence, provides an outer metal surface. Similarly, a metal shell may be deposited on to a dimpled molded golf ball. The previously described metal mantle may be used without a polymeric outer cover, and so, provide a golf ball with an outer metal surface. Providing a metal outer surface produces a scuff resistant, cut resistant, and very hard surface ball. Furthermore, positioning a relatively dense and heavy metal shell about the outer periphery of a golf ball produces a relatively low spinning, long distance ball. Moreover, the high moment of inertia of such a ball will promote long rolling distances.

The invention has been described with reference to the preferred embodiments. Obviously, modifications and alterations will occur to others upon reading and understanding the foregoing detailed description. It is intended that the invention be construed as including all such modifications and alterations insofar as they come within the scope of the appended claims or the equivalents thereof.

What is claimed is:

1. A golf ball having a hollow spherical center, said ball comprising:

a spherical metal mantle having an inner surface and an outer surface opposite from said inner surface, said mantle having a thickness from about 0.001 inches to less than 0.02 inches; and a polymeric outer cover disposed about said mantle and proximate to said outer surface, said polymeric cover comprising a material selected from the group consisting of a low acid ionomer, a non-ionomeric thermoplastic elastomer, and a blend of said low acid ionomer and said non-ionomeric thermoplastic elastomer; and further comprising:

an innermost polymeric hollow spherical substrate, said spherical substrate disposed adjacent to said inner surface of said mantle.

2. The golf ball of claim 1 wherein said mantle comprises at least one metal selected from the group consisting of steel, titanium, chromiun, nickel, and alloys thereof.

3. The golf ball of claim 2 wherein said mantle comprises a nickel titanium alloy.

4. The golf ball of claim 1 wherein said thickness ranges from about 0.005 to less than 0.02 inches.

5. The golf ball of claim 4 wherein said thickness ranges from about 0.005 inches to about 0.010 inches.

6. The golf ball of claim 1 wherein said outer cover has a modulus ranging from about 1000 psi to about 10,000 psi.

7. The golf ball of claim 1 wherein the polymeric outer cover comprises a material selected from the group consisting of a low acid ionomer and a blend of said low acid ionomer and a non-ionomeric thermoplastic elastomer, said low acid ionomer comprising less than 16% acid.

8. The golf ball of claim 1 further comprising:

a gas disposed within said substrate, said gas having a pressure of at least about 1 atmosphere at 70° F.

9. The golf ball of claim 1 wherein said substrate has a thickness from about 0.005 inches to about 0.010 inches.

10. The golf ball of claim 1 further comprising:

a gas disposed within said polymeric hollow spherical substrate, said gas having a pressure greater than 1 atmosphere at 70° F.

11. A golf ball having a hollow interior, said ball comprising:

a polymeric hollow spherical substrate, said substrate having an inner surface defining said hollow interior and an outer surface;

a spherical metal mantle having an inner surface directed toward said outer surface of said spherical substrate, and an oppositely directed outer surface; and a polymeric outer cover having an inner surface directed toward said outer surface of said metal mantle and immediately adjacent thereto, and an oppositely opposed directed outer surface, wherein said outer cover has a modulus ranging from about 1000 psi to about 10,000 psi.

12. The golf ball of claim 11 wherein said mantle comprises at least one metal selected from the group consisting of steel, titanium, chromium, nickel, and alloys thereof.

13. The golf ball of claim 11 wherein said mantle has a uniform thickness ranging from about 0.001 inches to about 0.050 inches.

14. The golf ball of claim 11 wherein said mantle comprises:

a first spherical metal shell providing said inner surface; and a second spherical metal shell providing said outer surface, said second shell disposed adjacent to said first shell.

15. The golf ball of claim 11 wherein said substrate has a thickness from about 0.005 inches to about 0.010 inches.

16. The golf ball of claim 11 further comprising:

a gas disposed within said hollow interior of said polymeric spherical substrate whereby the pressure of said gas is greater than 1 atmosphere at 70° F.

17. A golf ball having a hollow interior, said ball comprising:

a polymeric hollow spherical substrate, said substrate having an inner surface defining said hollow interior and an outer surface;

a spherical metal mantle having an inner surface directed toward said outer surface of said spherical substrate, and an oppositely directed outer surface; and a polymeric outer cover having an inner surface directed toward said outer surface of said metal mantle and immediately adjacent thereto, and an oppositely opposed directed outer surface, wherein the polymeric outer cover comprises a low acid ionomer comprising less than 16 weight percent acid.

18. The golf ball of claim 17 wherein said mantle comprises at least one metal selected from the group consisting of steel, titanium, chromium, nickel, and alloys thereof.

19. The golf ball of claim 18 wherein said mantle comprises a nickel titanium alloy.

20. The golf ball of claim 17 wherein said mantle has a uniform thickness ranging from about 0.001 inches to about 0.050 inches.

21. The golf ball of claim 20 wherein said thickness ranges from about 0.005 inches to about 0.050 inches.

22. The golf ball of claim 21 wherein said thickness ranges from about 0.005 inches to about 0.010 inches.

23. The golf ball of claim 17 wherein said mantle comprises:

a first spherical metal shell providing said inner surface; and a second spherical metal shell providing said outer surface, said second shell disposed adjacent to said first shell.

24. The golf ball of claim 23 wherein said first shell and said second shell independently comprise a metal selected from the group consisting of steel, titanium, chromium, nickel, and alloys thereof.

25. The golf ball of claim 24 wherein at least one of said first shell and said second shell comprise a nickel titanium alloy.

26. The golf ball of claim 17 wherein said substrate has a thickness from about 0.005 inches to about 0.010 inches.

27. The golf ball of claim 17 further comprising:

a gas disposed within said hollow interior of said polymeric spherical substrate whereby the pressure of said gas is greater than 1 atmosphere at 70° F.

28. A golf ball having a hollow spherical center, said ball comprising:

a spherical metal mantle comprising a first spherical metal shell providing an inner mantle surface and a second spherical metal shell providing an outer mantle surface, said second shell disposed adjacent to said first shell; and a polymeric outer dimpled cover disposed about said mantle and proximate to said outer mantle surface, said polymeric cover comprising a material selected from the group consisting of a low acid ionomer, a non-ionomeric thermoplastic elastomer, and a bled of said low acid ionomer and said non-ionomeric thermoplastic elastomer; and further comprising:

an innermost polymeric hollow spherical substrate, said spherical substrate disposed adjacent to said inner mantle surface.

29. The golf ball of claim 28 wherein said first shell and said second shell independently comprise a metal selected from the group consisting of steel, titanium, chromium, nickel, and alloys thereof.

30. The golf ball of claim 29 wherein at least one of said first shell and said second shell comprise a nickel titanium alloy.

31. The golf ball of claim 28 wherein said substrate has a thickness from about 0.005 inches to about 0.010 inches.

32. The golf ball of claim 28 further comprising:

a gas disposed within said polymeric hollow spherical substrate, said gas having a pressure greater than 1 atmosphere at 70° F.

* * * * *